US006036119A

United States Patent [19]

Welker

[11] Patent Number: 6,036,119

[45] Date of Patent: Mar. 14, 2000

[54] ELASTOMERIC VAPORIZING INJECTION NOZZLE

[75] Inventor: Brian H. Welker, Sugarland, Tex.

[73] Assignee: Welker Engineering Company, Sugar Land, Tex.

[21] Appl. No.: 09/140,710

[22] Filed: Aug. 26, 1998

[51] Int. Cl.[7] ..... B05B 1/30

[52] U.S. Cl. ..... 239/533.13; 137/843

[58] Field of Search ..... 239/533.13, 533.1, 239/546, 602, 452; 222/494; 137/903, 843

[56] References Cited

U.S. PATENT DOCUMENTS

| | | | |
|---|---|---|---|
| 124,840 | 4/1872 | Maclaren | 137/901 |
| 307,516 | 11/1884 | Anson | 137/901 |
| 401,588 | 4/1889 | Ray | 137/901 |
| 408,701 | 8/1889 | Everett | 137/901 |
| 444,912 | 1/1891 | Meany et al. | 137/901 |
| 772,910 | 10/1904 | McKechney | 137/901 |
| 2,373,555 | 4/1945 | Folke | 239/602 |
| 3,334,818 | 8/1967 | Moen | 239/428.5 |
| 4,550,749 | 11/1985 | Krikorian | 137/843 |
| 5,267,585 | 12/1993 | Jones | 137/240 |
| 5,383,648 | 1/1995 | Pipinias | 251/333 |

*Primary Examiner*—Steven O. Douglas
*Attorney, Agent, or Firm*—Herzog, Crebs & McGhee, LLP

[57] ABSTRACT

An elastomeric vaporizing injection nozzle for pipeline applications that provides an adjustable fluid flow rate, and a uniform, consistent and predictable spray pattern.

13 Claims, 1 Drawing Sheet

ELASTOMERIC VAPORIZING INJECTION NOZZLE

BACKGROUND OF THE INVENTION

1. Field of the Invention

This invention relates to the field of pipeline fluid handling systems and particularly injection nozzle liquid vaporizers for pipeline applications.

2. Related Art

Liquid injectors are utilized in various pipeline applications whereby liquid is injected into a pipeline in a vaporized uniform pattern. Typically an injection system includes a pump that pumps fluid through a check valve into a subsequent channel which is in fluid communication with a nozzle. The fluid then exits the nozzle into the pipeline. In some applications very low fluid flows are required. Many injectors that are utilized in pipeline systems do not provide a uniform fluid flow and the fluid is not vaporized at the point of injection. Also, some injectors tend to drip at low fluid flows. A uniform and consistent spray pattern is essential to control the amount of fluid to be injected into the pipeline. It is also essential to be able to vary the fluid flow rate to vary the amount of fluid injected into the pipeline without disrupting the uniformity of the spray pattern. The amount injected must be predictable over the range of fluid flow rates. Injectors that tend to drip at lower fluid flows do not provide the required predictability. Once fluid flow drops below a certain fluid velocity, the exiting fluid will drip rather than spray. A common injector design utilizes a nozzle head mechanism to control the fluid injection that has a narrow channel within and a conical exit orifice. This method of injection provides a non-uniform and unpredictable spray pattern. This method also tends to cause an undesired fluid drip to occur at lower velocity fluid flow levels. Also, the fluid is not vaporized at the point of injection. Another common method of injection utilizes an adjustable core valve member that can be adjusted to reduce the gap between the valve member and the valve seat, thereby controlling fluid flow to control the fluid injections. Non-uniformity and fluid drip results from this mechanization as well. The non-uniform spray pattern and the drip is due to variations in fluid velocity without an automatic adjustment by the valve member to compensate for variations in fluid velocity.

There are some prior art patents that address the use of an elastomeric body as a control valve member to accurately control fluid flow in a plenum. However, none are designed to perform the function of a control valve for an injector nozzle.

U.S. Pat. No. 5,383,648 issued Jan. 24, 1995 to Pipinias shows an elastomeric body having a surface with a curvature different than that of a pressure surface that forms a boundary of a plenum which has an orifice through which fluid flow is channeled. The elastomeric body is compressed against the pressure surface over an area that varies with compression force. The elastomeric body controls the opening of the orifice and thereby controlling fluid flow through the orifice.

U.S. Pat. No. 5,267,585 issued Dec. 7, 1993 to Jones shows an elastomeric body utilized as a control valve wherein the deformable elastomeric member is positioned to at least partially within the flow path of a fluid passing between an inlet and an outlet.

The above patents address the control of fluid flow through a plenum, duct, channel, or the like. None address an elastimeric valve body utilized to control fluid flow exiting an injection nozzle to generate a vaporized fluid conical jet spray.

In addition, there are some other prior art patents that use elastomeric members to accurately control fluid flow through a nozzle for a water hose or the like or to control fluid flow through a faucet. However, none are designed to perform the function of a control valve for an injector nozzle.

U.S. Pat. No. 408,701 issued Aug. 13, 1889 to McKechney shows a faucet with an elastomeric valve member for accurate self-acting fluid flow. This patent shows an elastomeric member utilized to accurately shut off an exit channel of a faucet end and is not intended to be a means for accurately injecting fluid out an exit orifice for the subject application.

U.S. Pat. No. 772,910 issued Oct. 18, 1904 to Everett shows a nozzle for a hose and not an injector.

A practical solution for an injector design that provides a uniform and predictable spray pattern for pipeline applications is needed.

SUMMARY OF INVENTION

It is in view of the above problems that the present invention was developed. The Applicant has taken a different approach than the above-cited patents. The Applicant has recognized the real need to provide a simple, reliable injector nozzle for pipeline applications. The applicant has also recognized the non-obvious inherent problems when utilizing the conventional methods described above.

It is an object of the invention to economically provide an injector nozzle for pipeline applications that provides an accurate, uniform, and predictable vapor mist conical spray pattern, and that can be adjusted to vary the fluid flow.

It is a further object of the invention to provide an injector nozzle that has the ability to instantly vaporize the fluid.

It is a further object of the invention to provide an injector nozzle that does not drip at lower fluid flow rates.

It is further the object of the invention to provide an injector nozzle that can vaporize as little as ¼ cc of injected fluid.

These above objects are achieved by utilizing an elastomeric vaporizing injection nozzle positioned at the fluid exit point where the principle of operation is the compression of an elastomeric ball thereby expanding its outer diameter against the inner diameter of a metallic cylinder lip forming a valve seat. An adjustment screw and a concave compression nut provide adjustment of opening pressure and flow rate. When the adjustment screw is tightened, the concave nut uniformly compresses the elastomeric ball against the valve seat and an opposing fixed compression member. Sufficient fluid flow pressure and fluid flow velocity is required to overcome the pressure surface formed between the elastomeric valve member and the valve seat. Once the pressure surface is overcome, fluid exits forming a vaporized conical spray pattern. As fluid pressure and velocity varies, the elastomeric member will automatically adjust. When increased, the opening between the valve member and the seat widens and when decreased the elastomeric valve expands back to wholly shut off fluid flow by reforming pressure surface. The adjustment screw can be tightened or loosened to adapt to the fluid pressure and velocity range of a given installation, thereby creating a drip-resistant conical spray pattern producing nozzle.

The invention thus provides an economical, safe, and low maintenance solution to solving the need for an accurate injection nozzle.

DESCRIPTION OF THE PREFERRED EMBODIMENTS

The invention is first described with reference to FIG. 1 which depicts an overall mini chemical pump assembly and an injection nozzle assembly attached. The detailed structure and function of the elastomeric injection nozzle head is then described with reference to FIG. 2.

Figure 1:
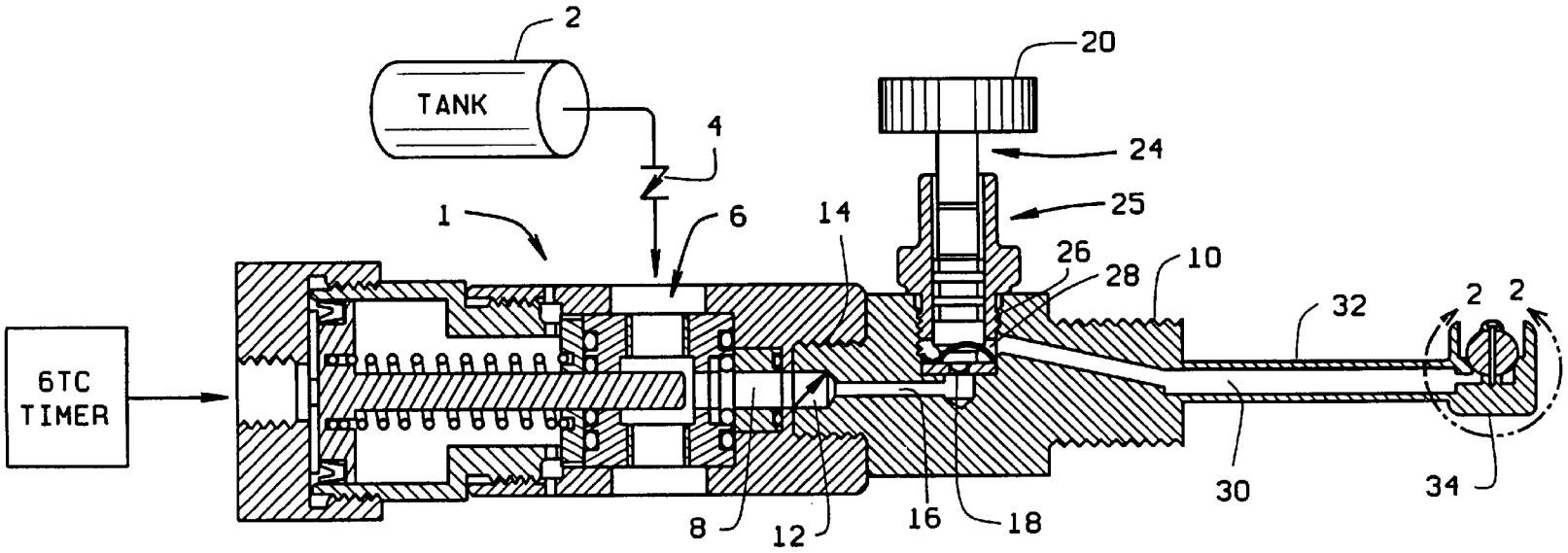
FIG. 1, an overall assembly diagram showing a cross section of a mini chemical pump with the injection nozzle installed thereon.

Referring to FIG. 1, there is a mini chemical pump 1 that is in fluid communication with a pressurized fluid holding tank 2 through a check valve 4. The mini pump 1 receives fluid from tank 2 into a pulse injecting sampling pump 6. Periodic samples of fluid fill the sampling chamber 8 and is then pumped through the check valve 12 of the nozzle assembly 10.

The nozzle assembly 10 attaches to mini pump 1 via a threaded interface 14. The fluid travels through the check valve 12 into a fluid passage 16. The fluid passage 16 is in fluid communication with valve 18 which is opened and closed by valve control knob 20. Valve control knob 20 is axially adjustable via its shaft 24 which screws in and out of collar 25. Collar 25 mounts in a threaded cylindrical hole 26. Cylindrical hole 26 is in volumetric communication with fluid chamber 28 which is in fluid communication with passage 16 when valve 18 is opened. When valve 18 is open, fluid flows from channel 16 to fluid chamber 28 and on to channel 30 of tubing 32.

Tubing 32 extends from the main body of the nozzle assembly 10. Opposite the main body end of the tubing, a nozzle head 34 is attached. The tubing 32 connects to the side wall of the nozzle head 34. The tubing 32 extension is constructed of ¼ inch tubing. The detail of the nozzle head 34 is seen in FIG. 2.

Figure 2:
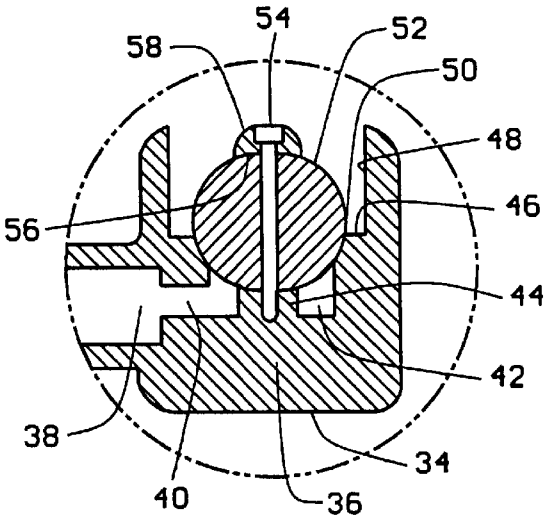
FIG. 2, a cross-sectional side view showing a detail of the injection nozzle head.

Referring to FIG. 2, a detail of the injector nozzle head 34 is shown. The injector nozzle body 36 is a cylindrically shaped solid with a fluid channel of varying diameters and contours throughout that has been cut out of the solid cylindrical body. The fluid channel cut out entry port is in fluid communication with fluid channel 30 whereby the injector nozzle head receives the injected fluid. Tubing 32 connects to the side wall of the nozzle head in a radial direction with respect to the nozzles cylindrical structure. In like manner channel 30 of tubing 32 merges in a radial direction with the entry port 38 of the channel cut out of the nozzle head thereby establishing fluid communication.

The channel cut out initially extends in a radial direction from the entry port 38. The channel cut out has a cylindrical shape at the entry port 38. The diameter is equal in diameter to channel 30 of tubing 32. The channel cutout has a stepped reduced diameter as it extends further in to the interior of the nozzle body in a radial direction at 40. The channel cutout extends further in the radial direction and opens to the vertically oriented portion 42 of the cylindrical channel cut out thereby forming a right angular bend in the channel cut out. The vertical portion 42 of the cylindrical channel cut out is symmetrical about the center axis of the nozzle head body 36.

The channel cut out axially extends from the right angular bend in one direction. The channel cut out extends to a stepped increased diameter forming an inner ledge 46 with a tapered corner thereby forming a valve seat 50. The increased diameter vertical cylindrical channel cut out extends to form the injection spray opening of the nozzle head 34.

On the back wall end of the vertical channel cut out directly opposite the injection spray opening at the right angular bend, there is a raised cylindrically shaped protrusion 44 from the nozzle body that is symmetrical about the cylindrical axis of the nozzle head. The protrusion has a concave end surface and a threaded axial hole. The protrusion 44 forms an inner compression member for the elastomeric valve 52.

The elastomeric valve 52 is spherical in shape, although other concentric shapes would work, such as egg-shaped, pear-shaped, etc. Spherical valve 52 is centered on the cylindrical axis of the nozzle head 34. The elastomeric valve 52 mechanically interfaces with valve seat 50. Valve seat 50 is chamfered to conform to the spherical shape of valve 52. The elastomeric valve 52 is uniformly compressed to symmetrically increase its diameter about the cylindrical axis of the nozzle head and increase the surface area of the valve that contacts the valve seat and to increase the pressure of the pressure surface between the valve 52 and the valve seat 50 thereby forming a uniform conical jet spray of the fluid that is able to penetrate between the pressure surface of members 50 and 52. The valve 52 is uniformly compressed by the screw 54 and the tapered nut 58 combination. This combination forms an adjustable compression causing member. The nut 58 has a concave taper to conform to the spherical shape of the valve 52. When screw 54 is tightened the nut 58 compresses the valve against the valve seat 50 and the opposing compression member 44.

The injected fluid that penetrates the pressure surface between the valve 52 and the valve seat 50 forms a uniform vaporized conical jet spray whose conical shape is defined by the tangential vector between the cylindrical axis of the nozzle head and the point of fluid penetration. The jet spray is then redirected at the point of intersection of said spray pattern's tangential vector and side wall 48. The resulting spray pattern will take on a more uniform cylindrical pattern.

In view of the foregoing, it is seen that the stated objects of the invention are achieved. The above description explains the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description shall be interpreted as illustrative rather than limiting. Thus, the breadth and scope of the present invention should not be limited by any of the above described exemplary embodiments, but should be defined in accordance with the following claims appended hereto and their equivalents.

The patents referenced herein are incorporated in their entirety for purposes of background information and additional enablement.

What is claimed is:

1. An elastomeric valved vaporizing injection nozzle for pipeline systems comprising:

a nozzle head having a centrally located cavity, a fluid exit orifice from said centrally located cavity, a fluid entry port to said centrally located cavity, and an inwardly radial ledge disposed on said head adjacent said orifice with a tapered lip that acts as a valve seat for a valve body;

an adjustable compression causing member;

a compressible elastomeric valve body member in mechanical communication with said valve seat with an outer diameter greater than an inner diameter of the tapered lip and disposed between the adjustable compression causing member and the tapered lip; and a deflector wall with a diameter greater than the diameter of the tapered lip, surrounding said valve body member and said valve seat, extending axially out and away from the valve seat and continuously around the perimeter of the valve seat.

2. The injection nozzle of claim 1 wherein said deflector wall has a cylindrical shape.

3. The injection nozzle of claim 1 wherein said compression causing member geometrically conforms to an exterior surface of said elastomeric valve body member.

4. The injection nozzle of claim 1 wherein said compression causing member is a nut.

5. The injection nozzle of claim 1 wherein said compressible elastomeric valve body member is in contact with a fixed compression member that opposes the adjustable compression member and is disposed on the opposing side of the tapered lip from the adjustable compression member.

6. The injection nozzle of claim 1, wherein said deflector wall is parallel to the nozzle head cylindrical axis.

7. The injection nozzle of claim 1 wherein said deflector wall forms an exit orifice intersecting the conical spray pattern.

8. The injection nozzle of claim 1 wherein said elastomeric valve body member has a spherical shape.

9. A valve device comprising:

an elastomeric valve adapted to diametrically expand when axially compressed;

a valve seat having an inwardly tapered lip adapted to receive said elastomeric valve forming a compression interface between said elastomeric valve and said valve seat;

an adjustable compression member that geometrically conforms to a first side of the elastomeric valve and is disposed on and contacts said first side of the elastomeric valve, thereby adapted to uniformly and adjustably compress the elastomeric valve against the valve seat; and a fixed inner compression member that geometrically conforms to the elastomeric valve and said fixed inner compression is wholly disposed on and contacts said elastomeric valve on an opposing second side of said elastomeric valve from said first side and said fixed compression member is disposed immediately beyond said compression interface; where said elastomeric valve diametrically expands across the valve seat when said adjustable compression member compresses said elastomeric valve against said valve seat restricting fluid flow.

10. The valve device of claim 9 where said adjustable compression member further comprises:

an annular body geometrically conforming to the elastomeric valve;

a screw that axially passes through the annular body and displaces said annular body thereby adjustably compressing the elastomeric valve to diametrically expand across the valve seat.

11. The valve device of claim 10, further comprising:

a threaded recess in the center of the fixed inner compression member and adapted to receive and engage a threaded shaft of said screw.

12. The valve of claim 9, further comprising:

a deflector wall uniformly and symmetrically intersecting a spray pattern of fluid flowing around said elastomeric valve and said wall adapted to redirect the spray path and forming an altered uniform and symmetrical spray pattern.

13. A valve device comprising:

a fixed inner compression that geometrically conforms to an exterior surface of a compressible elastomeric valve to uniformly resist a compression action of an opposing adjustable compressing member against said elastomeric valve, and said fixed compression member wholly disposed on the opposing side of the elastomeric valve from the opposing adjustable compressing member and disposed immediately beyond a mechanical contact between said elastomeric valve and a valve seat.

* * * * *